US011814805B1

(12) United States Patent
Martin

(10) Patent No.: US 11,814,805 B1
(45) Date of Patent: Nov. 14, 2023

(54) BOAT DOCK BUMPER AND METHOD OF USING THE SAME

(71) Applicant: Thomas R. Martin, Duluth, MN (US)

(72) Inventor: Thomas R. Martin, Duluth, MN (US)

( * ) Notice: Subject to any disclaimer, the term of this patent is extended or adjusted under 35 U.S.C. 154(b) by 0 days.

(21) Appl. No.: 17/551,378

(22) Filed: Dec. 15, 2021

(51) Int. Cl.
*E06C 9/08* (2006.01)
*E02B 3/26* (2006.01)
*E02B 3/28* (2006.01)

(52) U.S. Cl.
CPC . *E02B 3/26* (2013.01); *E02B 3/28* (2013.01)

(58) Field of Classification Search
CPC ... E02B 3/26; E02B 3/28; A01B 39/26; F16B 2/12; B60R 19/18; Y02A 30/30; B63B 59/02; E06C 1/04; E06C 9/08
See application file for complete search history.

(56) References Cited

U.S. PATENT DOCUMENTS 213,248 A * 3/1879 Beeves ..... B60J 7/1855 296/124
272,513 A * 2/1883 Baker ..... B65D 9/12 217/12 R
371,516 A * 10/1887 Nuckols ..... A01B 39/26 172/509
945,470 A * 1/1910 Meredith et al. ..... B60C 7/16 152/398
1,042,459 A * 10/1912 McDonald ..... A01B 39/26 172/509
1,270,844 A * 7/1918 Kirshner ..... B60R 19/285 293/135
1,271,786 A * 7/1918 Smith ..... B60R 19/285 293/135
1,313,282 A * 8/1919 Finnegan ..... B60R 19/20 293/138
1,315,789 A * 9/1919 Newton ..... F16B 2/12 248/228.3
1,338,048 A * 4/1920 Traupmann ..... B60R 19/285 293/155
1,342,374 A * 6/1920 Discher ..... B60R 19/023 280/854
1,344,797 A * 6/1920 Halladay ..... B60R 19/023 248/228.6

(Continued)

FOREIGN PATENT DOCUMENTS

CA 2172897 C 11/1999
CN 110091967 B 6/2020
JP 3935106 B2 6/2007

*Primary Examiner* — Edwin J Toledo-Duran
(74) *Attorney, Agent, or Firm* — Stinson LLP

(57) ABSTRACT

A boat dock bumper assembly configured for mounting on a boat dock and protecting a boat against damage from impacts with a side surface and a lower surface of the dock. The bumper assembly includes a clamp frame, an upper jaw, and a bumper. The upper jaw is movably coupled to the clamp frame for clamping a boat dock between the upper jaw and a lower jaw of the clamp frame. The bumper is joined to the clamp frame and has an upper portion and a lower portion. The upper and lower portions of the bumper may be integral or separable. The bumper is configured to absorb impacts from collisions between the boat and the dock. A method of protecting a boat against damage from impacts with a side surface and a lower surface of a boat dock using the bumper assembly.

20 Claims, 10 Drawing Sheets

(56) References Cited

U.S. PATENT DOCUMENTS 1,344,798 A * 6/1920 Halladay ..... B60R 19/023 293/140
1,364,878 A * 1/1921 Halladay ..... B60R 19/285 293/138
1,365,745 A * 1/1921 Taffee ..... B60R 19/285 293/155
1,411,051 A * 3/1922 McGowen ..... F16B 2/10 403/224
1,451,535 A * 4/1923 Cox ..... B60R 19/285 293/140
1,481,963 A * 1/1924 Lyon ..... B60R 19/285 293/140
1,504,947 A * 8/1924 Flum ..... B60R 19/285 293/148
1,515,566 A * 11/1924 Finnegan ..... B60R 21/34 293/42
1,538,426 A * 5/1925 Dunston ..... B60R 19/285 293/155
1,576,634 A * 3/1926 Donegan ..... B60R 19/023 248/278.1
1,610,937 A * 12/1926 Downey ..... B60R 19/285 293/140
1,896,277 A * 2/1933 Barry ..... B60R 19/44 293/143
2,012,921 A * 8/1935 Bahr ..... B62D 25/18 280/851
2,464,365 A * 3/1949 Aves ..... B60Q 9/003 D10/117
2,479,634 A * 8/1949 Marques ..... B60R 9/00 24/514
2,815,778 A * 12/1957 Holman ..... B25B 5/102 269/170
2,915,879 A * 12/1959 Besse ..... E02B 3/26 114/240 R
2,928,630 A * 3/1960 Wisman ..... B63H 20/106 248/641
2,928,631 A * 3/1960 Hartman ..... B63H 20/106 248/641
2,959,146 A * 11/1960 Erkert ..... B63B 59/02 293/120
2,964,767 A * 12/1960 Egbert ..... B63B 27/14 405/218
2,990,802 A * 7/1961 Ong ..... B63B 59/02 293/120
3,019,758 A * 2/1962 Erkert ..... B63B 59/02 293/120
3,077,175 A * 2/1963 Johnson ..... B63B 59/02 114/219
3,093,849 A * 6/1963 Iwanitza ..... B63B 59/02 114/364
3,125,979 A * 3/1964 Darling ..... E02B 3/26 114/219
3,335,689 A * 8/1967 Hein ..... E02B 3/26 293/120
3,353,812 A * 11/1967 Miller ..... E02B 3/26 267/140
3,402,558 A * 9/1968 Hellinger ..... E02B 3/26 114/220
3,603,510 A * 9/1971 Wagner ..... B63B 59/02 239/282
3,608,882 A * 9/1971 Culp ..... B65G 69/001 267/140
3,646,904 A * 3/1972 Lanning ..... B60F 3/0076 114/61.24
3,688,728 A * 9/1972 Lederer, Jr. ..... B63B 59/02 114/219
3,693,573 A * 9/1972 Murphy ..... B63B 59/02 114/362
3,771,778 A * 11/1973 Muller ..... B60R 19/20 267/140
3,865,041 A * 2/1975 Bacon ..... B61K 1/00 404/1
3,902,748 A * 9/1975 Bank ..... B60R 19/20 267/116
3,917,094 A * 11/1975 Magneson ..... B60P 3/1008 114/372
3,930,584 A * 1/1976 Davis ..... B60P 3/1016 414/462
3,975,916 A * 8/1976 Watson ..... E02B 3/26 405/212
4,061,385 A * 12/1977 Schwartzberg ..... B60R 19/20 293/120
4,073,528 A * 2/1978 Klie ..... B60R 19/18 293/122
4,084,533 A * 4/1978 Boyer ..... B63B 59/02 293/121
4,176,858 A * 12/1979 Kornhauser ..... B60R 19/20 280/736
4,697,956 A * 10/1987 Plaisance ..... E02B 17/003 114/220
4,773,349 A * 9/1988 McKinney ..... E02B 3/26 405/212
4,964,760 A * 10/1990 Hartman ..... E02B 3/26 405/215
4,970,980 A * 11/1990 Eisner ..... E02B 3/26 405/212
5,071,308 A * 12/1991 Tibbet ..... B60R 9/042 224/310
5,228,737 A * 7/1993 Zimmerman ..... B62D 25/12 292/276
5,361,715 A * 11/1994 Kiedaisch ..... B65G 69/001 267/140
5,493,991 A 2/1996 Wright
5,613,339 A * 3/1997 Pollock ..... E04B 5/12 52/177
5,638,628 A * 6/1997 Davis ..... A01K 91/065 43/4.5
5,740,752 A * 4/1998 Allenbaugh ..... B63B 59/02 114/230.1
5,743,204 A * 4/1998 Tweet ..... B63B 59/02 114/219
5,746,150 A * 5/1998 Beaulac ..... B63B 35/665 114/77 R
5,762,016 A * 6/1998 Parsons ..... E02B 3/26 114/230.26
6,095,074 A * 8/2000 Reinhardt ..... B63B 59/02 405/215
6,327,989 B1 * 12/2001 Beach ..... E02B 3/26 405/212
6,349,661 B1 * 2/2002 Dusek ..... E02B 3/26 114/219
6,364,293 B1 * 4/2002 Beckett ..... B63B 59/02 267/140
6,619,222 B1 * 9/2003 Clary ..... B63B 59/02 114/219
6,742,916 B1 * 6/2004 Dunn ..... B63B 45/04 362/540
6,758,156 B1 * 7/2004 Kobas ..... B63B 59/02 114/219
6,823,811 B1 * 11/2004 Drake ..... B63B 59/02 405/212
6,863,009 B1 * 3/2005 Driver ..... B63B 59/02 114/219
6,887,015 B1 * 5/2005 Blair ..... B63B 59/02 405/215
7,153,063 B2 12/2006 Griffen
7,293,518 B1 * 11/2007 Gassew ..... B63B 17/00 114/364
D557,652 S * 12/2007 Gassew ..... B63B 59/02 D12/317
7,305,931 B1 * 12/2007 Benson ..... B63B 7/082 114/345
7,418,911 B2 * 9/2008 McClintock ..... B63B 15/02 114/89
9,487,925 B1 * 11/2016 Meriwether ..... E02B 3/064
10,724,196 B2 7/2020 Levin
2004/0016383 A1 * 1/2004 Aschenbach ..... E02B 3/26 114/219

(56) References Cited

U.S. PATENT DOCUMENTS

| | | | | |
|---|---|---|---|---|
| 2005/0199170 | A1* | 9/2005 | Scotti | F16B 5/128 114/219 |
| 2005/0235896 | A1* | 10/2005 | Tsai | B63B 59/02 114/219 |
| 2006/0127181 | A1* | 6/2006 | DelZotto | E02B 3/068 405/86 |
| 2006/0182501 | A1* | 8/2006 | Griffen | E02B 3/26 405/212 |
| 2007/0107648 | A1* | 5/2007 | Rezzonico | B63B 59/02 114/219 |
| 2008/0293548 | A1* | 11/2008 | Moy | A63B 69/0048 482/36 |
| 2009/0151615 | A1* | 6/2009 | Sheedy | B63B 59/02 114/219 |
| 2009/0288587 | A1* | 11/2009 | Butters | B63B 59/02 114/219 |
| 2010/0031862 | A1* | 2/2010 | Powell | B63B 59/02 114/219 |
| 2011/0111871 | A1* | 5/2011 | Legary | A63G 31/007 472/128 |
| 2013/0036960 | A1* | 2/2013 | Berman | B63B 59/02 114/219 |
| 2014/0056013 | A1* | 2/2014 | Hancock, Jr. | B63B 59/02 362/477 |
| 2015/0152616 | A1* | 6/2015 | Taylor | E02B 3/26 405/212 |
| 2015/0314841 | A1* | 11/2015 | Moran | E02B 3/26 114/219 |
| 2016/0263807 | A1* | 9/2016 | Baxter | B29C 48/16 |
| 2019/0249824 | A1* | 8/2019 | Floe | F16M 13/02 |
| 2020/0199838 | A1* | 6/2020 | DeMay | E02B 3/26 |
| 2022/0325491 | A1* | 10/2022 | Miller | B63B 59/00 |

* cited by examiner

BOAT DOCK BUMPER AND METHOD OF USING THE SAME

CROSS-REFERENCE TO RELATED APPLICATIONS

Not Applicable.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The invention relates to a bumper assembly that may be installed, for example, on a boat dock to reduce or prevent damage caused by collisions between a boat and the dock.

2. Description of Related Art

Bumpers are often installed on the sides of a boat dock to minimize damage from collisions or impacts between the dock and a boat that is moored to the dock. While there are many different types of bumpers suitable for being installed on docks, many conventional bumpers are designed for permanent installation on a single dock or for removable attachment to a piling. If a boat is moored at a dock that lacks permanent bumpers or lacks features that would be compatible with an available removable bumper, the boat will be comparatively unprotected against collisions with the dock. It can be appreciated that it would be both costly and impractical to equip every dock with permanent bumper fixtures or to standardize the dimensions and features of every dock to be compatible with a specifically dimensioned removable bumper. In addition, conventional bumpers are primarily designed to protect against horizontal collisions with a dock and not vertical collisions that may occur, for example, if a boat travels beneath the dock and is subsequently heaved upward toward the bottom of the dock.

BRIEF SUMMARY OF THE INVENTION

A boat dock bumper assembly in accordance with an exemplary embodiment of the invention described herein is configured for mounting on a boat dock and protecting a boat against damage from impacts with a side surface and a lower surface of the dock. The boat dock bumper assembly includes a clamp frame, an upper jaw, and a bumper. The clamp frame has an upright portion and a lower jaw coupled to the upright portion. The upper jaw is movably coupled to the clamp frame for clamping a boat dock between the lower jaw and the upper jaw. The bumper is coupled to the clamp frame and has a lower portion extending downward from the lower jaw and an upper portion extending outward from the upright portion of the clamp frame. The lower portion of the bumper may absorb impacts from a portion of a boat moving upward toward a lower surface of the dock, and the upper portion of the bumper may absorb impacts from a portion of a boat moving laterally toward a side surface of the dock.

In some embodiments, the lower jaw is configured for engaging a portion of the lower surface of the dock, and the upper jaw is configured for engaging a portion of an upper surface of the dock.

In some embodiments, the boat dock bumper assembly includes a top portion coupled to the upright portion, and the upper jaw is movably coupled to the top portion. The top portion and the lower jaw may extend outward from the upright portion in the same direction. The top portion may define a threaded opening, and the upper jaw may comprise a screw comprising an upper end and a lower end, a clamp surface coupled to the lower end of the screw, and a handle coupled to the upper end of the screw. The screw is configured for engaging the threaded opening in the top portion.

In some embodiments, the bumper comprises at least one of a flexible polymeric material, foam, or rubber. In some embodiments, the lower portion of the bumper and the upper portion of the bumper are integral. In some embodiments, the upper portion of the bumper is separable from the lower portion of the bumper.

The invention is also directed to a method of protecting a boat against damage from impacts with a side surface and a lower surface of a boat dock including the steps of providing a boat dock bumper assembly as described above, positioning the bumper assembly on the boat dock such that the lower jaw is adjacent a lower surface of the dock and the upright portion is adjacent a side surface of the dock, and moving the upper jaw with respect to the clamp frame to clamp a portion of the dock between the upper jaw and the lower jaw in a position such that the lower portion of the bumper extends outward from and covers at least a portion of the lower surface of the dock and the upper portion of the bumper extends outward from and covers at least a portion of the side surface of the dock.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF EXEMPLARY EMBODIMENTS

Figure 6:
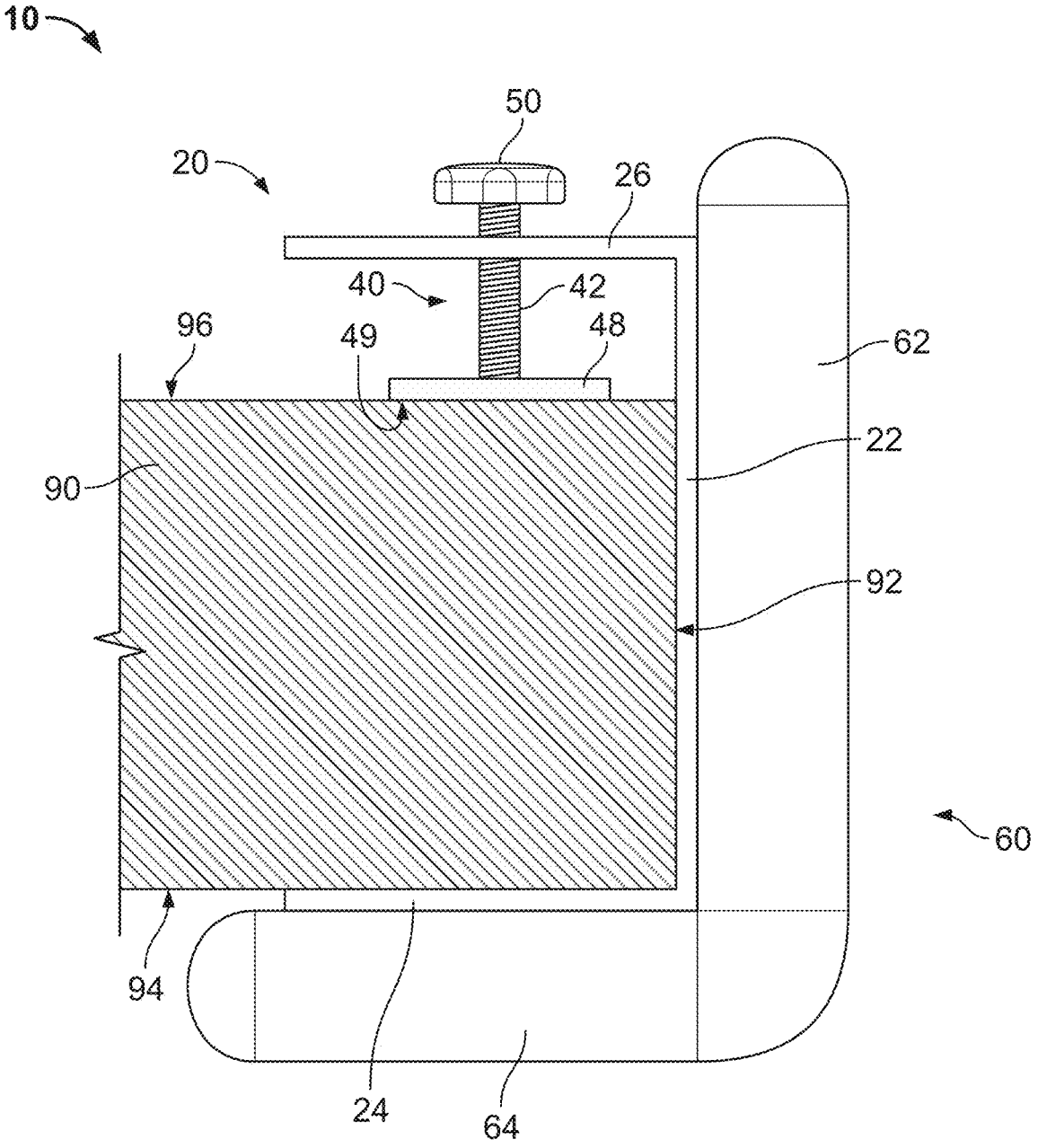
FIG. 6 is a cross-sectional view taken through the line 6-6 in FIG. 5.
Figure 7:
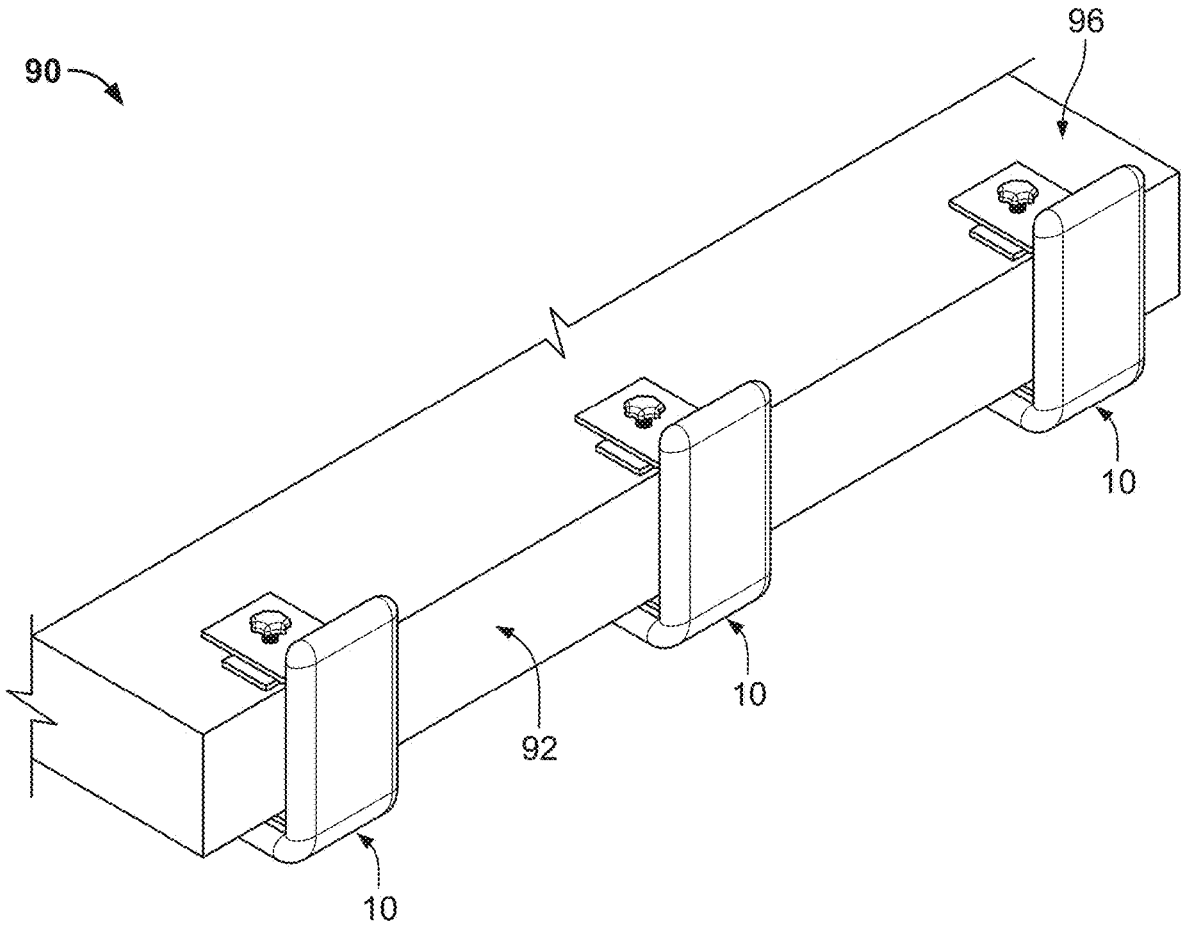
FIG. 7 is a side perspective view of a dock showing a plurality of bumper assemblies clamped to the dock.
Figure 8:
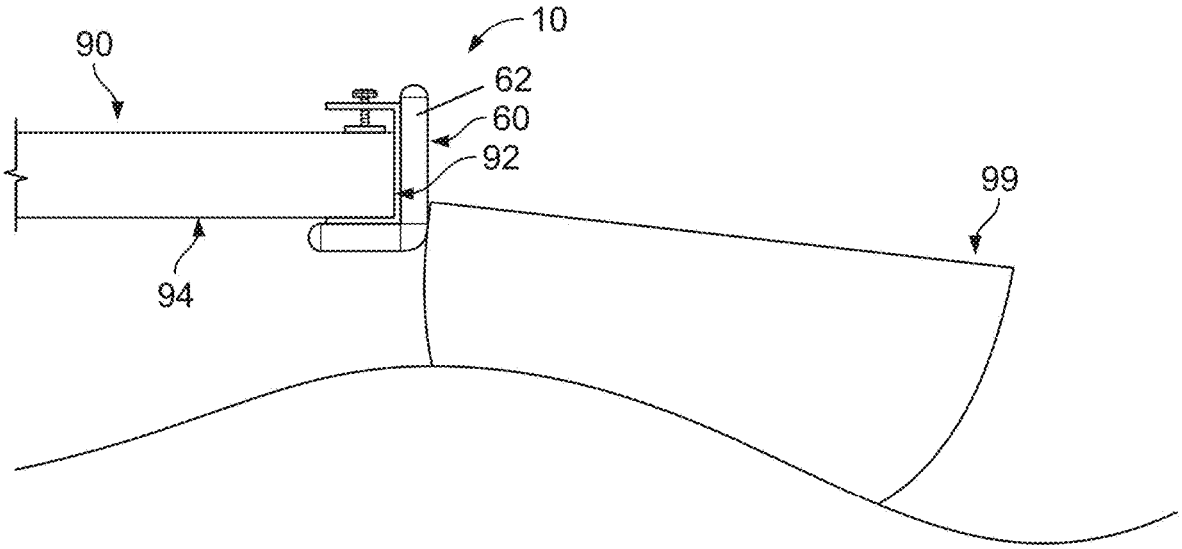
FIG. 8 is a side view of the boat dock bumper assembly clamped on a boat dock with a moored boat generally adjacent the side of the dock.
Figure 9:
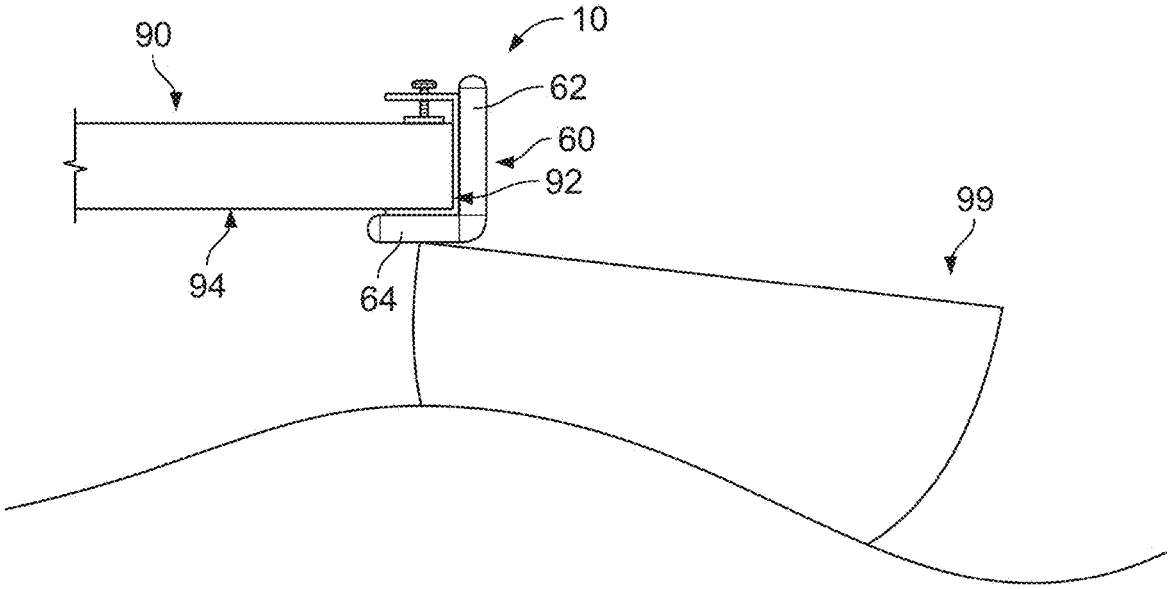
FIG. 9 is a side view of the boat dock bumper assembly and boat dock shown in FIG. 8 with a portion of the moored boat below and generally adjacent the bottom of the dock.

A boat dock bumper assembly in accordance with an exemplary embodiment of the invention described and claimed herein is identified generally as 10 in FIGS. 1-9. As described in more detail below, the bumper assembly 10 is configured for being releasably secured to a boat dock and for stowing on a boat while not in use. For example, as is best seen in FIGS. 8 and 9, the bumper assembly 10 can be clamped to a dock 90 to protect a boat 99 from horizontal and vertical collisions with the dock. Specifically, the bumper assembly 10 has a bumper 60 with an upper portion 62 and a lower portion 64 each made of a cushioning material that covers portions of a vertical side 92 and a lower surface 94, respectively, of dock 90. As shown in FIG. 8, when the boat's hull travels generally horizontally toward dock 90 due to a wave, a current, or another force, the upper portion 62 of bumper 60 cushions the impact and prevents the boat from colliding with the vertical side 92 of dock 90. Additionally, as shown in FIG. 9, when the boat's hull travels beneath dock 90 and is pushed upward due to, e.g., a turbulent wave, the lower portion 64 of bumper 60 cushions the impact and prevents the boat from colliding with the lower surface 94 of dock 90.

Figure 1:
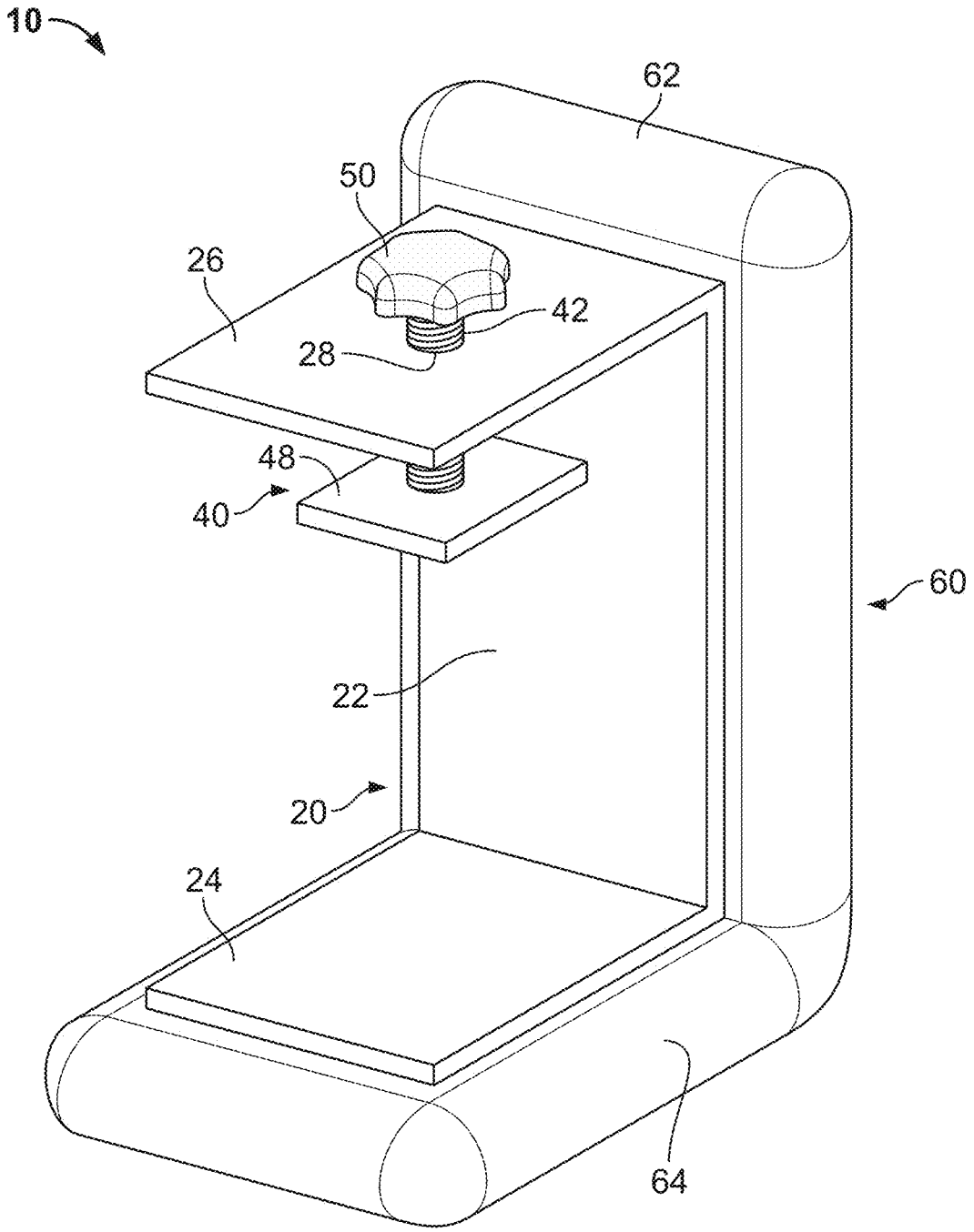
FIG. 1 is a front perspective view of a boat dock bumper assembly in accordance with one embodiment of the invention described herein.

As shown in FIG. 1, the bumper assembly 10 includes a clamp frame 20, an upper jaw 40, and a bumper 60. The clamp frame 20 has an upright portion 22, a lower jaw 24 extending outward from one end of the upright portion 22, and a top portion 26 extending outward from the end of the upright portion 22 opposite the lower jaw 24. The lower jaw 24 and top portion 26 are each generally perpendicular to the upright portion 22; however, they may extend outward from the upright portion 22 at any suitable angle. At the center of top portion 26 is a threaded hole 28. The upper jaw 40 is configured to engage the threaded hole 28, as described in more detail below. The upright portion 22, the lower jaw 24, and the top portion 26 are flat, rectangular elements that form a C-shaped frame in combination. In at least some embodiments of the bumper assembly 10 described herein, the clamp frame 20 may be a single integrated part. The upright portion 22, the lower jaw 24, and the top portion 26 may also be formed separately and joined, e.g., by welding. The clamp frame 20 may be formed from a strong, corrosion-resistant material, such as stainless steel, that can withstand the forces sustained during regular operation.

Figure 2:
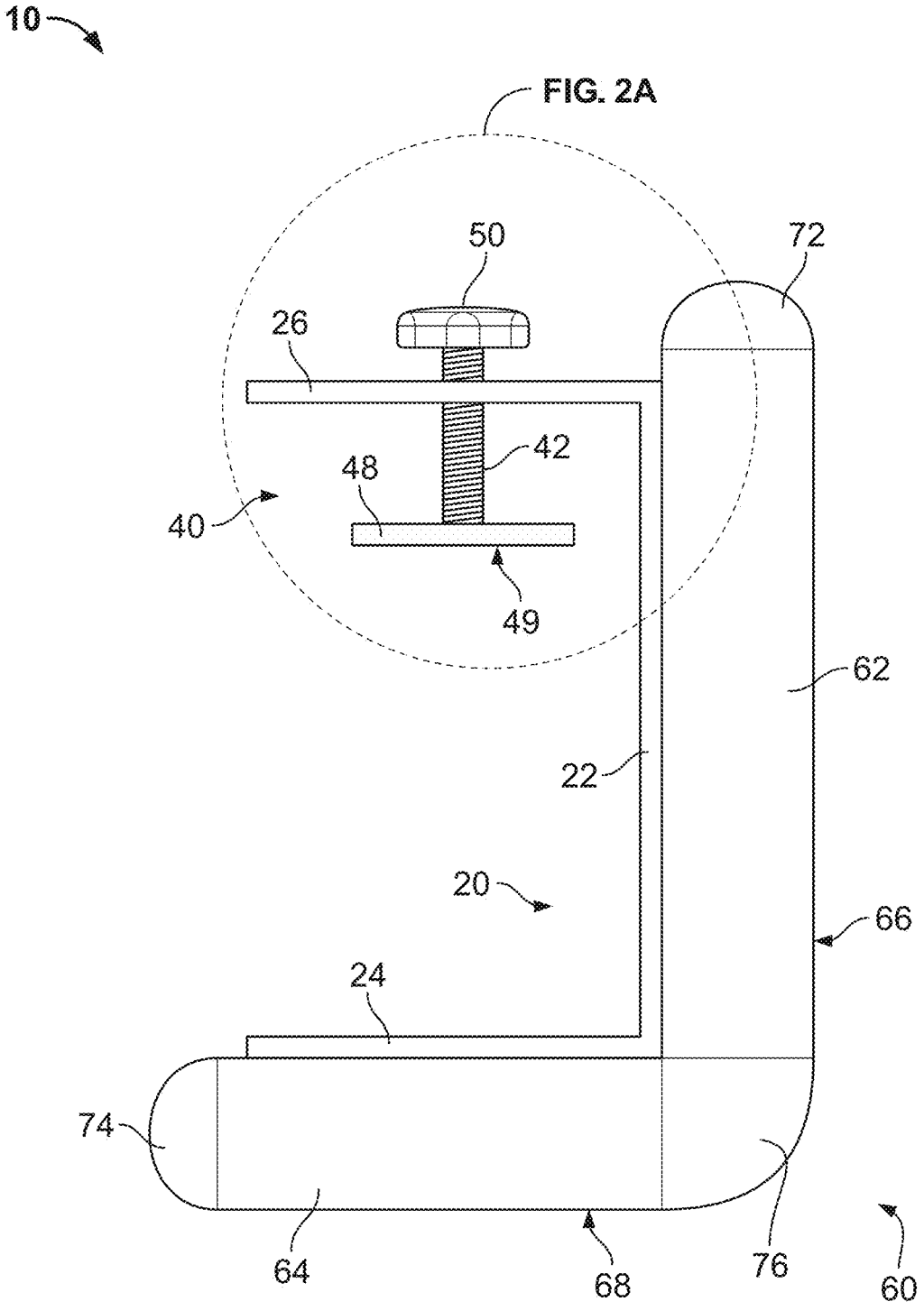
FIG. 2 is a side view of the bumper assembly shown in FIG. 1.
Figure 3:
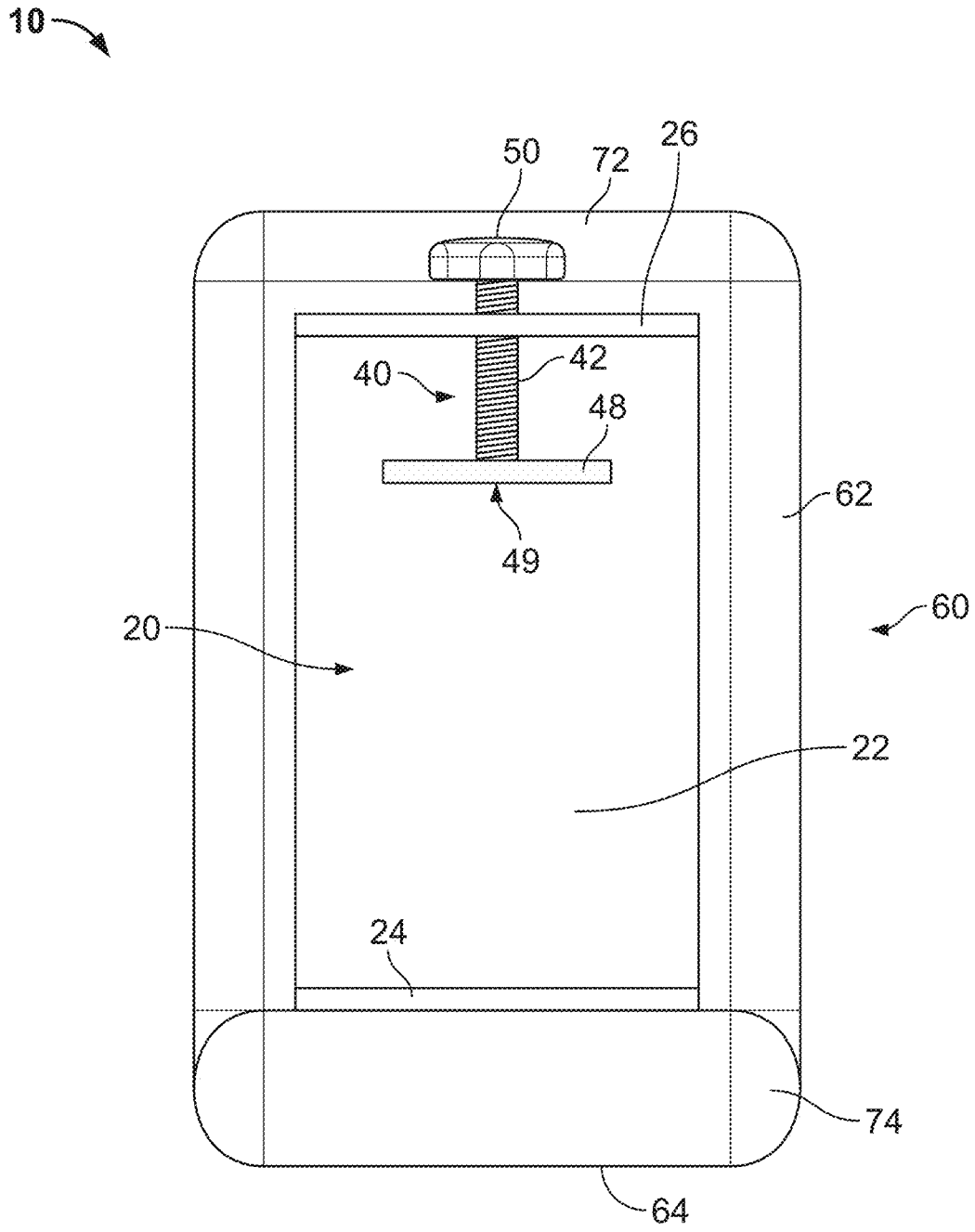
FIG. 3 is a front view of the bumper assembly shown in FIG. 1.
Figure 4:
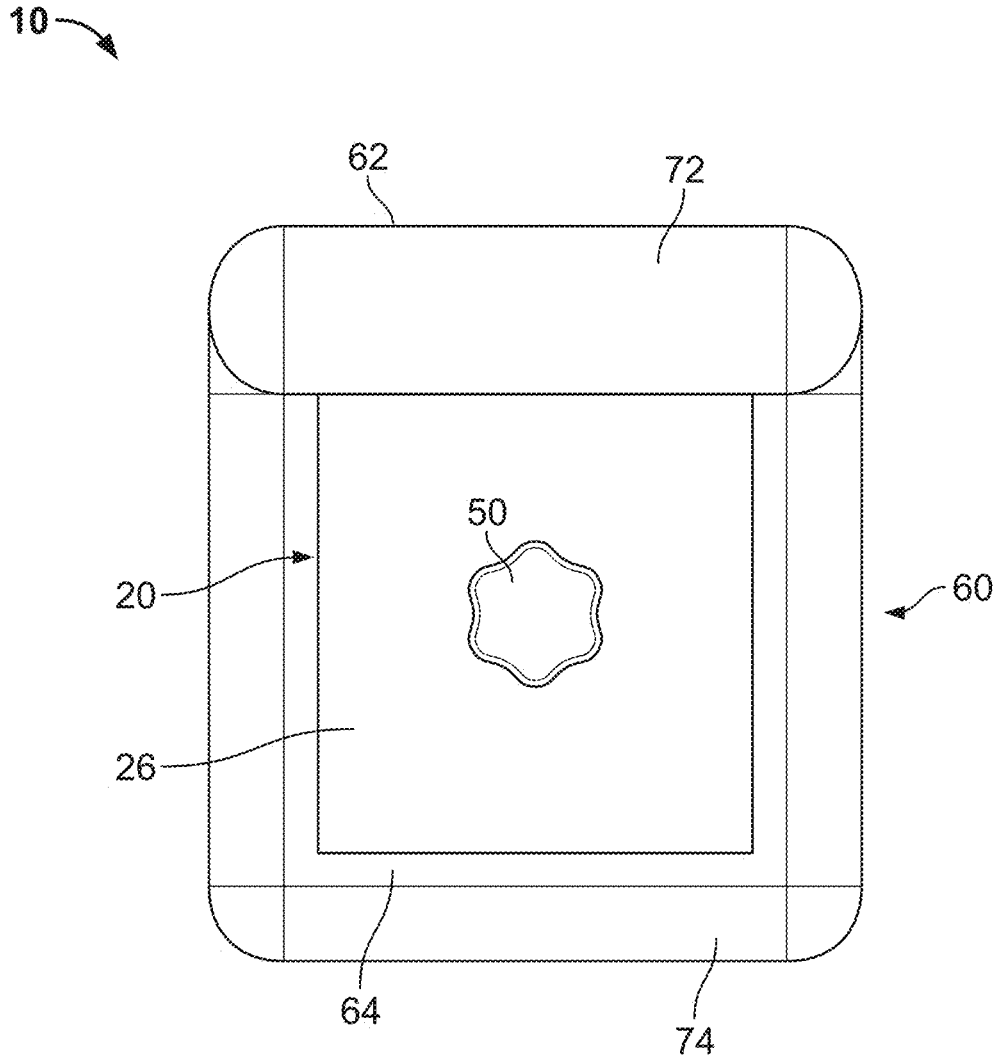
FIG. 4 is a top view of the bumper assembly shown in FIG. 1.
Figure 5:
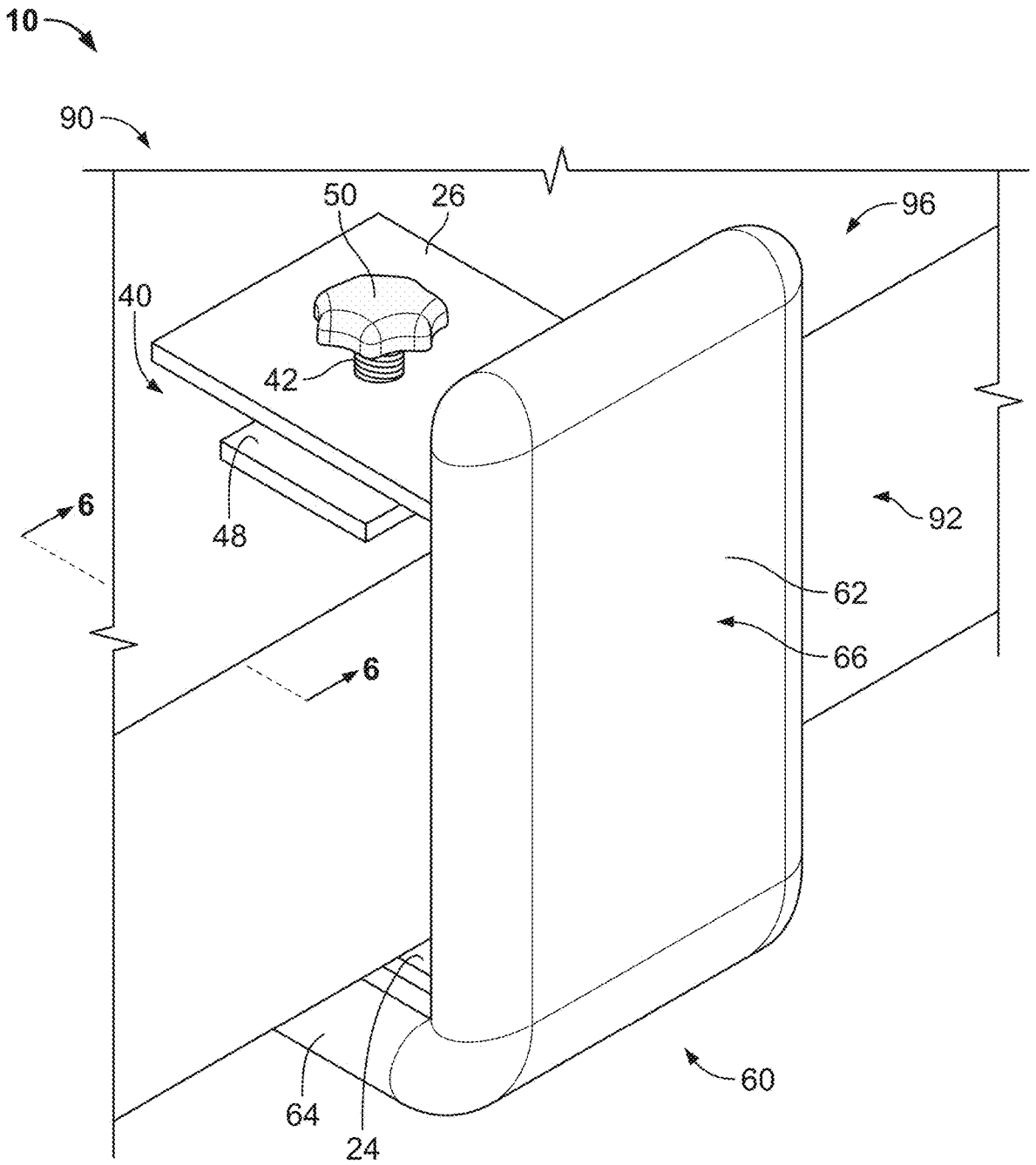
FIG. 5 is a side perspective view of the boat dock bumper assembly of FIG. 1 clamped on a boat dock.

Referring to FIG. 2, the bumper 60 includes the upper portion 62, which is attached to and extends outward from the upright portion 22, and the lower portion 64, which is attached to and extends downward from the lower jaw 24. The upper and lower portions 62 and 64 have substantially flat outside surfaces 66 and 68, respectively, as well as substantially rounded edges 72 and 74, respectively. The upper and lower portions share a rounded corner 76 at their intersection. As shown in FIGS. 3 and 4, it will be appreciated that the upper and lower portions 62 and 64 can extend laterally beyond the width of the clamp frame 20. The bumper 60 can be joined to the clamp frame 20 in any suitable manner. For example, the bumper 60 and the clamp frame can be fastened together, joined with a marine-grade adhesive sealant, or coupled in any other manner conducive to operating the bumper assembly 10 described herein. As shown in FIGS. 1-9, the bumper 60 may be an integrated, "L"-shaped part that is not divided into discrete upper and lower portions 62 and 64. In alternative embodiments, the upper and lower portions 62 and 64 may be discrete elements, e.g., as described below in connection with the embodiment shown in FIGS. 10 and 11. The components of the bumper 60 are designed to withstand and absorb the impact of a collision (or multiple collisions) between a boat and a dock while preventing or reducing damage to the boat and dock. The bumper 60 may be made of a resilient, UV-resistant and marine-resistant material, such as a marine grade polymer, a high-density foam, rubber, or any combination of like materials. The bumper 60 may have any thickness that is suitable for protecting a boat and a dock.

Figure 2A:
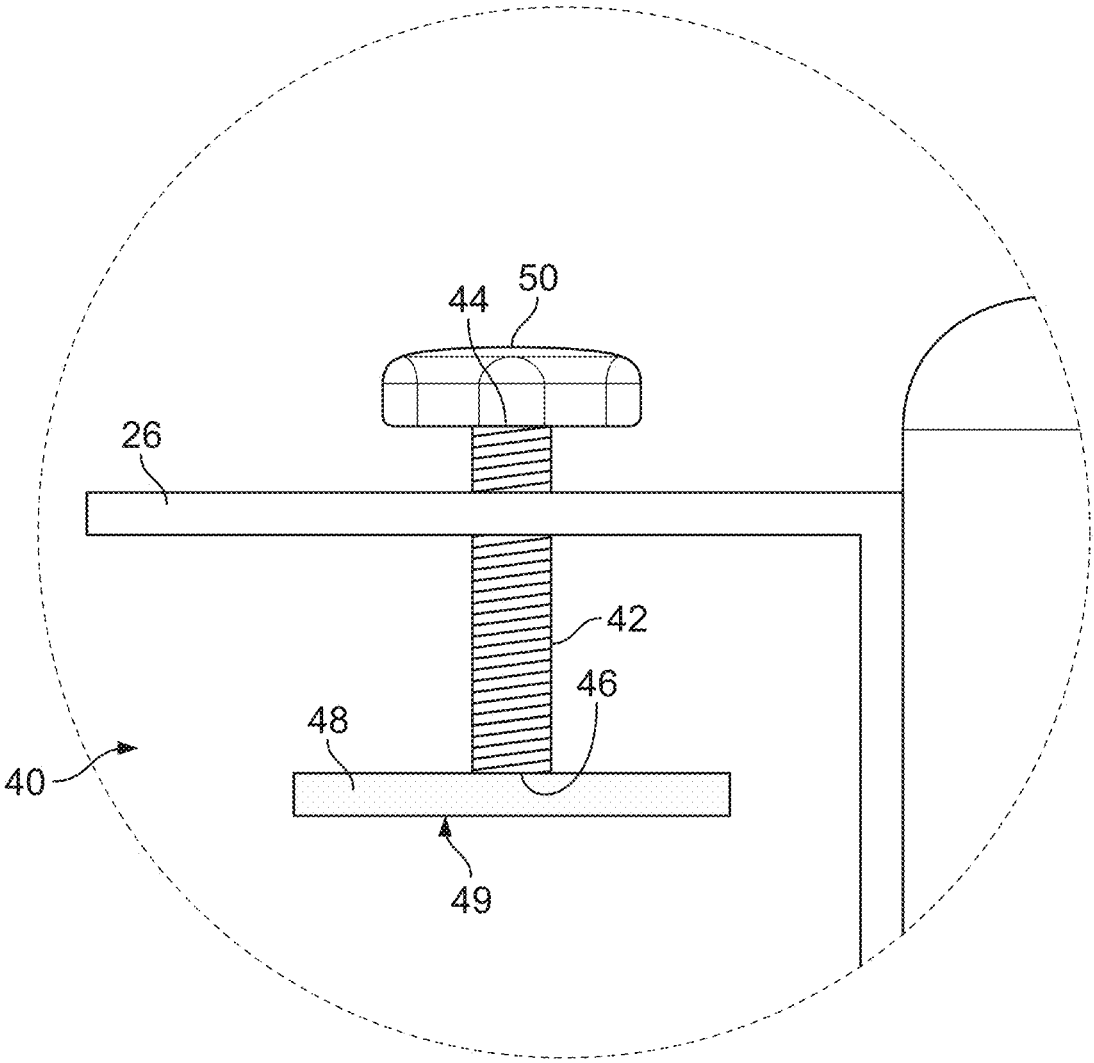
FIG. 2A is a detail view of the area referenced as FIG. 2A in FIG. 2.

Referring to FIGS. 2A and 3, the upper jaw 40 is movable and includes a threaded screw 42 with an upper end 44 and a lower end 46, a contact plate 48 coupled to the lower end 46, and a handle 50 coupled to the upper end 44. The screw 42 engages the threaded hole 28 (FIG. 1), allowing the upper jaw 40 to travel upward relative to the clamp frame 20 when the screw is rotated in one direction using handle 50 and downward when the screw is rotated in an opposite direction using handle 50. The screw 42 may be made of a durable, corrosion-resistant metal.

The handle 50 is joined to the upper end 44 to facilitate rotation of the screw 42. The handle 50 is depicted herein as a water-resistant, UV-resistant thermoplastic knob with finger grips. Of course, the handle 50 can have another design, such as that of a T-shaped grip, a hose valve handle, or a spring-loaded sliding bar handle, and it can be made of another durable material suitable for outdoor, marine use.

As depicted in FIGS. 1-3, the contact plate 48 is flat and rectangular and is joined to the lower end 46 of the screw 42 at the center of the rectangular profile of the contact plate 48. The contact plate 48 is large enough to provide a clamp surface 49 with sufficient surface area for engaging the dock 90 during operation of bumper assembly 10. At the same time, the contact plate 48 is compact enough to fit in the structure of clamp frame 20 when the upper jaw 40 is mounted on the top portion 26 via the threaded hole 28. When the upper jaw 40 is mounted on the clamp frame 20, the contact plate 48 is generally parallel to the lower jaw 24 and operates as an upper clamp jaw for the bumper assembly 10. The contact plate 48 and the lower jaw 24 are separated by a distance that can vary depending on the relative position of the screw 42 within the threaded hole 28. The separation distance ranges from slightly less than a minimum dock thickness (allowing for the bumper assembly 10 to be secured on a dock having the minimum thickness) to slightly more than a maximum dock thickness (e.g., of at least 12 inches) (allowing for the bumper assembly 10 to be placed on a dock having the maximum thickness). The contact plate 48 may be formed of a rigid, corrosion-resistant material that can withstand compression between screw 42 and boat dock 90.

As shown generally in FIG. 7, the dock 90 is a rectangular structure that is supported by pilings or pontoons (not shown) and rests a distance above water level. The dock 90 has a vertical side 92, a lower surface 94 (FIG. 6), and an upper surface 96. The upper surface 96 is substantially flat, though it will be appreciated that the upper surface may comprise a plurality of planks arranged in close alignment. Further, the dock 90 includes a frame supporting the upper surface 96, the frame defining at least a portion of the lower surface 94 of the dock opposite the upper surface 96. The lower surface 94 of the dock 90 does not need to be planar or one continuous surface. For example, the lower surface 94 of the dock 90 in one particular area may be at a higher elevation over the water than the lower surface 94 of the dock 90 in another area. In particular, if the dock 90 includes planks supported on a frame, the portion of the lower surface 94 defined by the frame may be at a lower elevation over the water than the portion of the lower surface 94 defined by the planks in an area where the frame is not directly beneath the planks. The vertical side 92 surrounds the perimeter of the dock and may be a part of the frame. Dock 90 is one example of a dock to which bumper assembly 10 may be clamped. It will be understood that a variety of other docks can be used with the invention, the other docks having different geometries or alternative features like metal frames or brackets, posts, walls, cleats, or ladders.

In operation, the bumper assembly 10 is clamped on dock 90, as shown in FIGS. 6-9, before, simultaneous with, or after the mooring of a boat 99 to dock 90. The bumper assembly 10 is primarily designed to protect the boat 99 against collisions with the dock 90. The bumper assembly 10 must be placed on the dock 90 before it can be secured in place by the tightening of upper jaw 40. It will be appreciated that the position of the upper jaw 40 may require adjustment prior to placement so clamp frame 20 fits generally around the vertical side 92. After placement but before the assembly has been secured, the clamp surface 49 of upper jaw 40 abuts a portion of the upper surface 96, and the upright portion 22 of clamp frame 20 generally abuts or is positioned adjacent to a portion of the vertical side 92. Additionally, before the assembly has been secured, the lower jaw 24 rests adjacent a portion of lower surface 94 without engaging it. When the bumper assembly 10 is positioned in this manner, the lower portion 64 of the bumper 60 covers at least a portion of the lower surface 94, and the upper portion 62 of the bumper 60 covers at least a portion of the vertical side 92.

After the assembly is placed on the dock, an operator can secure the bumper assembly 10 to dock 90 by tightening the upper jaw 40. Specifically, the operator can turn the handle 50 in a tightening direction, resulting in the relative downward movement of the screw 42. As a result of the tightening motion, the clamp frame 20 is displaced upward until the lower jaw 24 engages a portion of the lower surface 94 of the dock 90. During this process, the upper jaw 40 remains in engagement with the upper surface 96. Thus, as is seen in FIG. 6, the dock 90 becomes clamped between the upper jaw 40 and the lower jaw 24. Surface friction created by the compressive forces keeps the bumper assembly 10 secured in place.

When the bumper assembly 10 is secured, it acts as a buffer between the dock 90 and any nearby boats 99, minimizing damage that would result from a horizontal or vertical collision directly with the dock 90. For example, referring to FIG. 8, a wave or current may cause the hull of the boat 99 to rock or travel generally horizontally toward the dock 90, and the upper portion 62 of the bumper 60 can guard the boat from a direct collision with the vertical side 92 of the dock, reducing the potential for structural damage (whether to the boat or to the dock). Similarly, referring to FIG. 9, a wave may cause the hull of the boat 99 to dip beneath the dock 90 and then travel back upward. The lower portion 64 of the bumper 60 can guard the boat 99 from a direct collision with the lower surface 94 as the boat travels upward.

At some point, the operator may wish to detach the bumper assembly 10 from the dock 90, e.g., if a boat departs from the dock and bumpers are no longer needed for protection. By rotating the handle 50 in a loosening direction, the operator can cause the relative upward movement of the screw 42. As a result of this motion, the lower jaw 24 relaxes and separates from the lower surface 94 while the upper jaw 40 generally remains resting on the upper surface 96. The operator can then remove the bumper assembly 10 from the dock, making the bumper assembly available for placement at a later time, whether on the same dock or on a new dock. It will be appreciated that the removed bumper assembly 10 can be stowed on a boat, allowing for convenient transportation of the bumper assembly to a new dock when the boat is again stationed.

As can be seen in FIG. 7, multiple bumper assemblies 10 can be installed on boat dock 90 simultaneously. As an illustrative example, if more than one boat 99 is moored at boat dock 90, a plurality of bumper assemblies 10 may be clamped on the boat dock 90 generally adjacent each moored boat. As another example, if a moored boat 99 has unique dimensions or is large, several bumper assemblies 10 may be placed at multiple locations adjacent the boat, e.g., one adjacent the boat's bow and one adjacent the boat's stern, allowing for simultaneous protection at multiple locations on the dock 90. These examples are illustrative only, and it is understood that the boat dock bumper assembly 10 can be used in other arrangements consistent with the descriptions herein.

Figure 10:
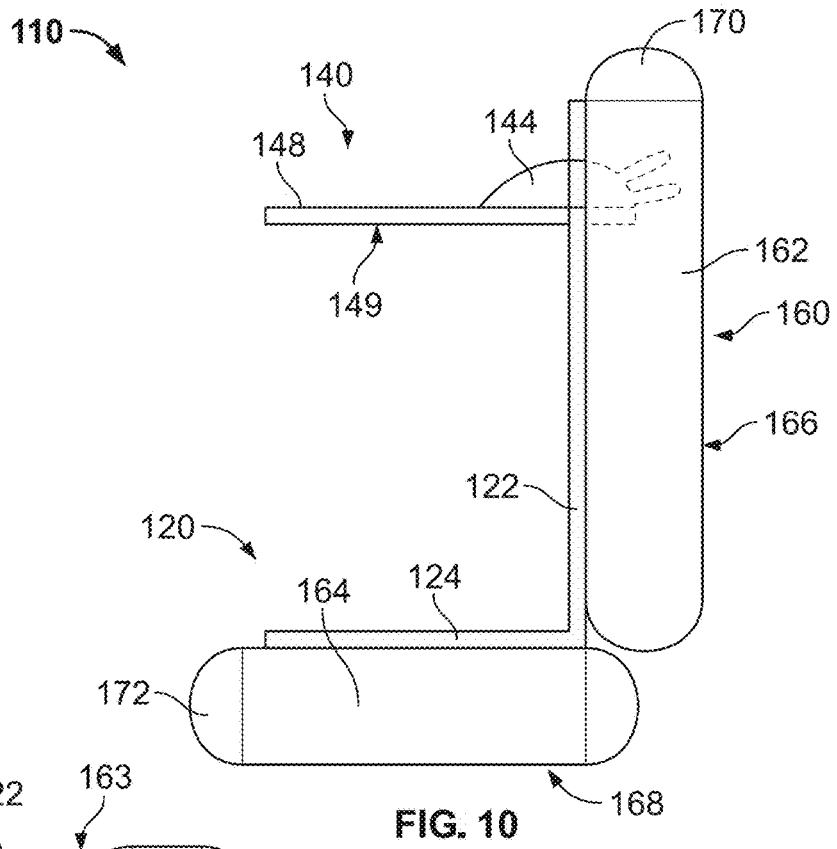
FIG. 10 is a side view of an alternative bumper assembly in accordance with another embodiment of the invention described herein.
Figure 11:
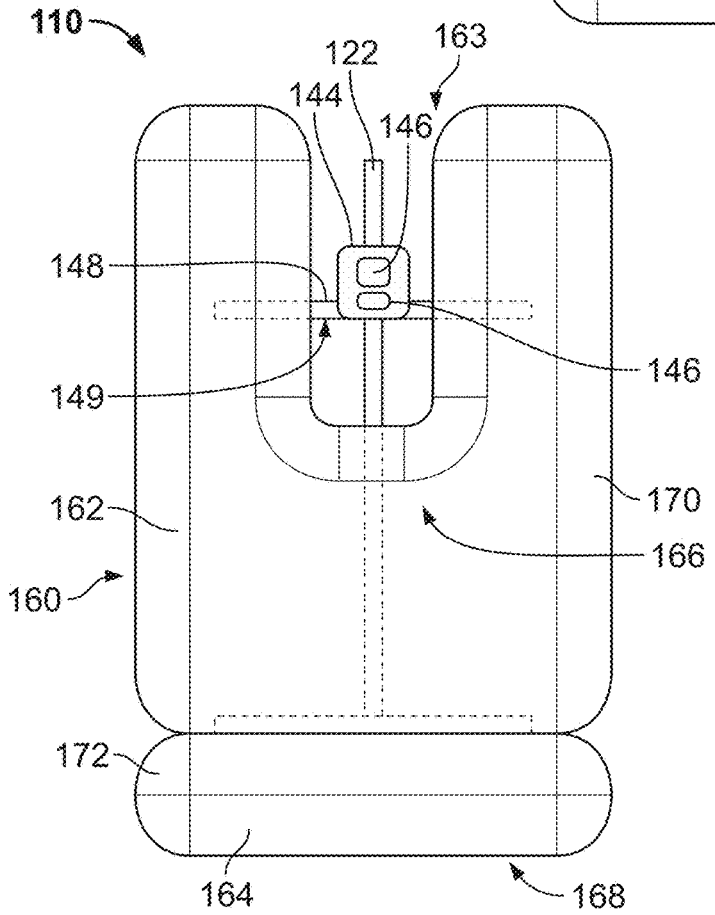
FIG. 11 is a rear view of the bumper assembly shown in FIG. 10.

An alternative embodiment of bumper assembly 110, shown in FIGS. 10 and 11, has a clamp frame 120, an upper jaw 140, and a bumper 160 with a different configuration than the bumper assembly 10 described above. In this embodiment, clamp frame 120 has an upright portion 122 and a lower jaw 124. Instead of having a top portion for housing the upper jaw, this embodiment includes an upper jaw 140 that is joined directly to upright portion 122. For example, in FIGS. 10 and 11, the clamp frame 120 and the upper jaw 140 function in a similar manner as a bar clamp with a ratcheting jaw. The upper jaw 140 has a contact plate 148 with a clamp surface 149, a ratcheting connector 144 movably connected to the upright portion 122, and handles 146 that extend outward from the ratcheting connector 140. The contact plate 148 is positioned generally parallel to the lower jaw 124 and can move toward and away from the lower jaw 124 as the handles 146 are manipulated, thereby allowing the ratcheting connector 144 to travel vertically up and down with respect to the upright portion 122. The bumper 160 has an upper portion 162 and a lower portion 164 that is independent and separate from the upper portion 162. The upper portion 162 extends outward from the upright portion 122 and has a substantially flat outside surface 166 and substantially rounded edges 170. The lower portion 164 extends downward from (and is coupled to) the lower jaw 124 and has a substantially flat outside surface 168 and substantially rounded edges 172. While the lower portion 164 generally covers all of the lower jaw 124 of the clamp frame 120, the upper portion 162 has a U-shaped profile that includes a cutout 163 exposing an upper span of the upright portion 122 and the handles 146. The base of the upper portion 162 of the bumper 160 abuts and covers a lower span of the upright portion 122. The cutout 163 in the top end of upper portion 162 provides space for the upper jaw 140 to travel vertically along upright portion 122. The cutout 163 allows the upper jaw 140 to travel relative to the lower jaw 124 from a minimum distance that is slightly less than a minimum dock thickness to a maximum distance that is slightly more than a maximum dock thickness. It can be appreciated that the handles 146 do not protrude farther than the outside surface 166 of the upper portion 162, i.e., the boat 99 will not collide with the handles 146.

In operation, the bumper assembly 110 is clamped on the dock 90 before, simultaneous with, or after the mooring of a boat 99 to the dock 90. The bumper assembly 110 is primarily designed to protect the boat 99 against collisions with the dock 90. Placement and use is generally consistent with the embodiment described above in connection with FIGS. 7, 8, and 9, except that the assembly 110 is secured to the dock 90 by squeezing the ratchet handles 146 together, urging the upper jaw 140 into compression against upper surface 96, and releasing the ratchet handles 146 to lock the upper jaw 140 to the upright portion 122. Further, the ratcheting connector 144 is configured so that it can be released by an operator when it is desired for the bumper assembly 110 to be detached from the dock 90, e.g., by squeezing the ratchet handles 146 together and moving the upper jaw 140 upward.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A boat dock bumper assembly configured for mounting on a boat dock and protecting a boat against damage from horizontal and vertical impacts, the bumper assembly comprising:

a clamp frame comprising an upright portion and a lower jaw coupled to the upright portion;

an upper jaw movably coupled to the clamp frame for clamping a boat dock between the lower jaw and the upper jaw; and a bumper coupled to the clamp frame, the bumper comprising a lower portion extending outward from the lower jaw to cushion vertical impacts and an upper portion extending outward from the upright portion of the clamp frame to cushion horizontal impacts, the upper portion and the lower portion each comprising a resilient material configured to absorb the impact of a collision with a boat and subsequently return to substantially its original shape;

wherein the lower portion is configured to cushion vertical impacts between a boat and the lower portion when a boat dock is clamped between the lower jaw and the upper jaw, and the upper portion is configured to cushion horizontal impacts between a boat and the upper portion when a boat dock is clamped between the lower jaw and the upper jaw.

2. The bumper assembly of claim 1, wherein the lower jaw is configured for engaging a lower surface of the dock, and the upper jaw is configured for engaging an upper surface of the dock.

3. The bumper assembly of claim 1, wherein the clamp frame further comprises a top portion coupled to the upright portion, the upper jaw movably coupled to the top portion.

4. The bumper assembly of claim 3, wherein the top portion and the lower jaw extend outward from the upright portion in the same direction.

5. The bumper assembly of claim 3, the top portion defining a threaded opening, wherein the upper jaw comprises:

a screw comprising an upper end and a lower end, the screw engaging the threaded opening in the top portion;

a contact plate coupled to the lower end of the screw; and a handle coupled to the upper end of the screw.

6. The bumper assembly of claim 5, wherein the upper jaw is configured such that rotating the screw in a first direction moves the contact plate toward the lower jaw and rotating the screw in a second direction moves the contact plate away from the lower jaw.

7. The bumper assembly of claim 1, wherein the upper portion of the bumper is substantially parallel to the upright portion of the clamp frame, and wherein the lower portion of the bumper is substantially parallel to the lower jaw.

8. The bumper assembly of claim 1, wherein the upper portion of the bumper is wider than the upright portion of the clamp frame.

9. The bumper assembly of claim 1, wherein the upper portion of the bumper is taller than the upright portion of the clamp frame.

10. The bumper assembly of claim 1, wherein the lower portion of the bumper is wider than the lower jaw.

11. The bumper assembly of claim 1, wherein the lower portion of the bumper is longer than the lower jaw.

12. The bumper assembly of claim 1, wherein the lower portion of the bumper is configured to extend partially beneath the boat dock when the boat dock is clamped between the upper jaw and the lower jaw.

13. The bumper assembly of claim 1, wherein the lower portion of the bumper and the upper portion of the bumper form an "L" shape.

14. The bumper assembly of claim 1, wherein the bumper comprises at least one of a flexible polymeric material, foam, or rubber.

15. The bumper assembly of claim 1, wherein the upper portion of the bumper and the lower portion of the bumper are integral.

16. The bumper assembly of claim 1, wherein the upper portion of the bumper is separable from the lower portion of the bumper.

17. A boat dock bumper assembly configured for mounting on a boat dock and protecting a boat against damage from horizontal and vertical impacts, the bumper assembly comprising:

a clamp frame comprising an upright portion and a lower jaw coupled to the upright portion;

an upper jaw movably coupled to the clamp frame for clamping a boat dock between the lower jaw and the upper jaw; and a bumper coupled to the clamp frame, the bumper comprising a lower portion extending downward from the lower jaw to cushion vertical impacts and an upper portion extending outward from the upright portion of the clamp frame to cushion horizontal impacts, the upper portion and the lower portion each comprising a resilient material configured to absorb the impact of a collision with a boat and subsequently return to substantially its original shape;

wherein the lower portion of the bumper is configured for absorbing impacts from a portion of a boat moving upward toward a lower surface of the dock, and wherein the upper portion of the bumper is configured for absorbing impacts from a portion of a boat moving laterally toward a side surface of the dock.

18. The bumper assembly of claim 17, wherein the upper portion of the bumper and the lower portion of the bumper are integral.

19. The bumper assembly of claim 17, wherein the upper portion of the bumper is separable from the lower portion of the bumper.

20. A method of protecting a boat against damage from horizontal and vertical impacts when the boat is moored to a boat dock, the method comprising the steps of:

providing a bumper assembly comprising a clamp frame comprising an upright portion and a lower jaw coupled to the upright portion, the bumper assembly further comprising an upper jaw movably coupled to the clamp frame, and a bumper comprising a lower portion extending outward from the lower jaw and an upper portion extending outward from the upright portion of the clamp frame, the upper portion and the lower portion each comprising a resilient material configured to absorb the impact of a collision with a boat and subsequently return to substantially its original shape;

positioning the bumper assembly on the boat dock such that the lower jaw is adjacent a lower surface of the dock and the upright portion is adjacent a side surface of the dock; and moving the upper jaw with respect to the clamp frame to clamp a portion of the dock between the upper jaw and the lower jaw in a position such that the lower portion of the bumper extends outward from and covers at least a portion of the lower surface of the dock to cushion a boat against damage from vertical movement relative to the boat dock and the upper portion of the bumper extends outward from and covers at least a portion of the side surface of the dock to cushion the boat against damage from lateral movement relative to the boat dock.

* * * * *